United States Patent [19]

Hara

[11] 4,210,893

[45] Jul. 1, 1980

[54] THERMAL CUT-OFF FUSE

[75] Inventor: Kunio Hara, Kawasaki, Japan

[73] Assignee: Nifco Inc., Yokohama, Japan

[21] Appl. No.: 957,390

[22] Filed: Nov. 3, 1978

[30] Foreign Application Priority Data

Nov. 4, 1977 [JP] Japan ..... 52-131426
Jul. 6, 1978 [JP] Japan ..... 53-92313[U]

[51] Int. Cl.[2] ..... H01H 37/76
[52] U.S. Cl. ..... 337/407; 337/408
[58] Field of Search ..... 337/401, 402, 403, 404, 337/405, 406, 407, 408, 409

[56] References Cited

U.S. PATENT DOCUMENTS 4,080,586 3/1978 Hay et al. ..... 337/407

*Primary Examiner*—Harold Broome

*Attorney, Agent, or Firm*—Glenn W. Bowen; Robert W. Beart

[57] ABSTRACT

A thermal cut-off fuse comprises a housing, a pair of terminals opposed to each other within the housing, a sliding means constantly urged by a spring, a thermal pellet adapted to melt at a fixed elevated temperature and remain in a solid state at normal room temperature and, by virtue of the solid state, restrain the sliding means from the forward motion imparted thereto by the spring and consequently serve to form a continuous space between the pair of terminals, and a conductive material disposed within the space to establish electric continuity between the terminals. When the ambient temperature is elevated to reach the fixed level, the thermal pellet melts, to release the sliding means and allow it to move under the force of the spring into a position where it severs the continuous space and consequently breaks the electric continuity between the two terminals.

7 Claims, 14 Drawing Figures

THERMAL CUT-OFF FUSE

BACKGROUND OF THE INVENTION

This invention relates to a thermal cut-off fuse which is used in an electric appliance incorporating a heat-generating element to serve the purpose of opening the electric circuit of the electric appliance when the ambient temperature of the appliance is elevated to a danger level.

One of the various types of thermal cut-off fuses uses a thermal pellet made of a thermally sensitive material which retains a solid state at temperatures not exceeding a fixed level and assumes a liquid state on being elevated to reach the fixed level. This thermal cut-off fuse substantially comprises a pair of terminals, a conductive, elastic contact member interposed between the two terminals, a thermal pellet adapted to remain in a solid state at normal room temperature and, by virtue of this solid state, restrain the elasticity of the contact member and, and thereby, establish electric continuity between the two terminals. When the ambient temperature of this fuse is elevated to the danger level, the thermal pellet melts and releases the contact member from the restrained elasticity. Consequently, the contact member severs the electric continuity between the two terminals to fulfill the purpose of the fuse.

The conventional thermal cut-off fuse of such a construction has a possibility of being accidentally brought into the state of broken electric continuity such as on exposure to external impulses or in consequence of degradation of elasticity because the contact member serving to establish the electric continuity between the terminals relies for its perfect contact upon the elasticity of its own material. Further because of the requirement that the area in which such a contact is made should be minimized to ensure improved sensitivity of the contact motion, the fuse suffers from a high contact resistance and tends to provide inferior efficiency for use as an element in the electric circuit. Generally thermal cut-off fuses of an ordinary run are required to be available in a small size of the order of 5 mm in diameter and 1 cm or less in length, so that they inevitably entail a drawback that the assembly of their minute component parts necessitates high skill on the part of workers.

An object of the present invention is to provide a thermal cut-off fuse which enjoys high accuracy of response to the fixed temperature level, possesses an ability to assume the state of a broken electric continuity without fail, offers no appreciable resistance of contact and enjoys simplicity of fabrication.

SUMMARY OF THE INVENTION

To accomplish the object described above according to the present invention, there is provided a thermal cut-off fuse which comprises a housing; a pair of terminals opposed to each other across a space within the housing and extended out of the housing via respective lead wires for external continuity; a sliding means disposed within the space intervening between the two terminals and energized constantly in the direction of at least one terminal; a conductive material disposed within the space formed between the two terminals and adapted to assume a fluidified state at least before it reaches the prescribed temperature level; and a thermal pellet interposed between the terminal toward which the sliding means is urged and the sliding means and adapted to retain a solid state at normal temperatures not exceeding the aforementioned fixed level and assume a liquid state on reaching the fixed level.

Since the thermal pellet which retains a solid state at normal temperatures is interposed between the one terminal and the sliding means urged toward this one terminal, the motion of the sliding means is restrained and the space formed between the opposed terminals is kept in a state of continuity so that the electric continuity between the two terminals is established through the medium of the conductive material. When the ambient temperature of the fuse rises to reach the danger level, the thermal pellet melts into a fluidified state and permits the sliding means to move in the direction in which it is energized. Consequently, at least a part of the continuous space between the two terminals is eliminated so as to break the electric continuity between the terminals. The accuracy of response to the temperature of this fuse is extremely high because of adoption of a thermal pellet excelling in temperature responsivity. The fuse experiences no appreciable loss and excels in electric conductivity because the thermal pellet remains in contact with the two terminals and connects the two terminals while keeping wide contact areas of conduction as though it covered the entire exposed surfaces of the terminals. Further, since the conductive material interposed between the two terminals is capable of being fluidified, it readily breaks and therefore brings about the state of broken electric continuity without fail.

The other objects and characteristics features of the present invention will become apparent from a detailed description to be given herein below with reference to the accompanying drawing.

DETAILED DESCRIPTION OF THE PREFERRED EMBODIMENT

Figure 1:
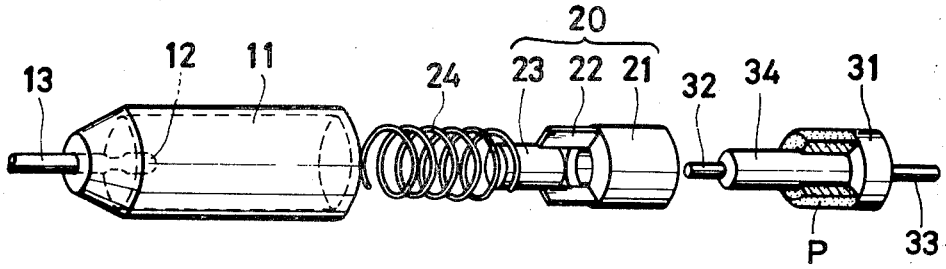
FIG. 1 is an exploded view of the first preferred embodiment of the thermal cut-off fuse of this invention.
Figure 2:
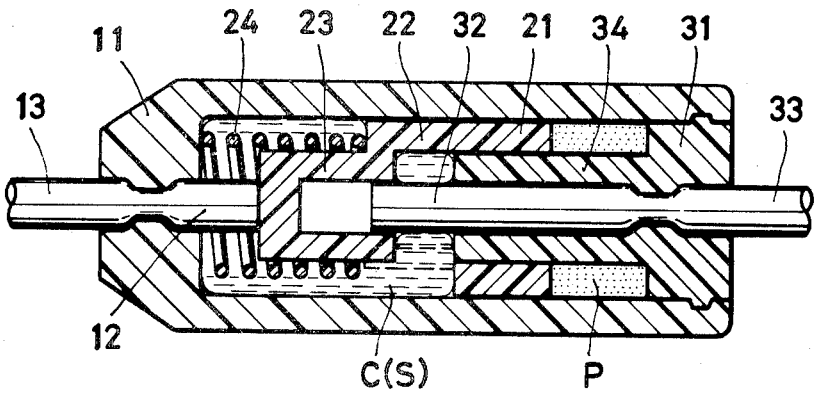
FIGS. 2(A) and 2(B) are sectional side views of the thermal cut-off fuse of FIG. 1, respectively in the state of closed continuity and in the state of broken continuity.
Figure 2:
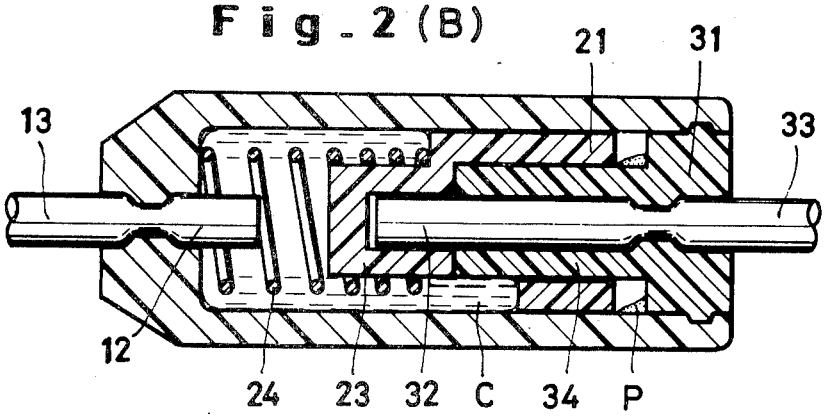

FIGS. 1 to 2 represent the first preferred embodiment of the thermal cut-off fuse of the present invention. A housing 11 made of a suitable material such as synthetic resin has at one end thereof an opening and at the other end thereof a lead wire 13 which is provided at the inner side thereof with a terminal 12 and extended outwardly at the opposite outer side thereof. Inside this housing 11 is stowed a sliding means 20 energized with a spring 24 as shown in FIG. 2. The opening of the housing 11 is closed with a bushing 31 incorporating the terminal 32. Before these component parts are assembled, an appropriate amount of a conductive material C is placed inside the housing 11. A substance such as mercury which possesses fluidity even at normal temperatures is preferably used as the conductive material. Otherwise, a fusible alloy such as soft solder which assumes fluidity at temperatures below the preset temperature level may be used as the conductive material. Thus, the conductive material C placed inside the housing 11 serves the purpose of establishing electric continuity between the two terminals 12, 32.

The sliding means 20 is integrally formed of a large-diameter cylindrical portion 21 having an outside diameter substantially conforming with the inside diameter of the housing 11, a plurality of ribs 22 and a small-diameter cylindrical portion 23, with the ribs serving to connect the two cylindrical portions therethrough to each other. The small-diameter cylindrical portion 23 is closed at one end and possesses an inside diameter substantially conforming with the diameter of the terminal 32.

The bushing 31 is integrally provided with a sleeve 34 which allows a lead wire 33 to be introduced in an insulated state into the housing interior and connected to the terminal 32 exposed at the leading end thereof. The outside diameter of the sleeve 34 substantially conforms with the inside diameter of the large-diameter cylindrical portion 21. The length of the sleeve 34 is greater than the total of the length of the large-diameter cylindrical portion 21 and the distance between the large-diameter cylindrical portion 21 and the small-diameter cylindrical portion 23. Further, around the periphery of the sleeve 34, there is provided a thermal pellet P the length of which equals the distance that separates the large-diameter cylindrical portion 21 and the bushing 31 from each other when the bushing 31 is fastened inside the housing 11 and the sliding means 20 is moved to the farthest point of its travel inside the housing 11 in the direction in which it is energized by the spring 24 as shown in FIG. 2(A). Accordingly, the thermal pellet P which assumes a solid state at normal temperatures functions to retain the sliding means 20, so far as the ambient temperature is normal, at the position separated most from the bushing 31 in spite of the urging force of the spring 24. In this manner, the space formed around the periphery of the terminal 12 continues into the space surrounding the periphery of the small-diameter cylindrical portion 23 and into the space formed around the periphery of the other terminal 32. The conductive material C, therefore, fills this continuous space S and, owing to this unbroken connection, serves to establish electric continuity between the two terminals.

In the state of FIG. 2(B), when the ambient temperature rises to reach the preset level, namely the temperature at which the thermal pellet p melts, the pellet is immediately liquefied and decreased in volume. Consequently, the sliding means 20 which has been restrained in its motion in the direction of the bushing 31 is released from that restraint so that it is moved by the urging force of the spring 25 toward the bushing 31 until the terminal face of the small-diameter cylindrical portion 23 collides into the leading end of the sleeve 34. This movement of the sliding means 20 completely eliminates the space around the periphery of the terminal 32 and causes the portion of the conductive material C which was present in the vicinity of the terminal 12 to be driven away from the periphery of the terminal 32, with the result that the electric continuity between the two terminals is broken. Since the sleeve 34 and the sliding means 20 fit intimately to each other, this state of broken continuity is retained unaffected by external impacts such as vibrations unless the spring 24 is broken.

Figure 3:
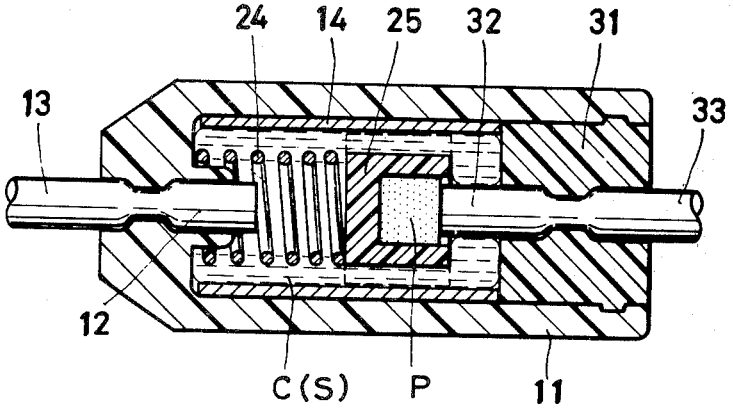
FIG. 3(A) is a perspective view of a sliding means to be used in the second preferred embodiment of the thermal cut-off fuse of this invention.
FIGS 3(B) and 3(C) are side views of the second preferred embodiment of the thermal cut-off fuse of this invention, respectively in the state of closed continuity and in the state of broken continuity.

The second preferred embodiment shown in FIG. 3 is a slightly simplified version of the preferred embodiment so far described. The simplification is conspicuous in the sliding means 25 which has the shape of a cup.

Figure 3A:
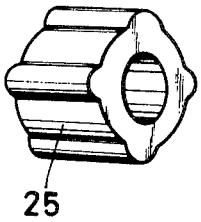
Figure 3:
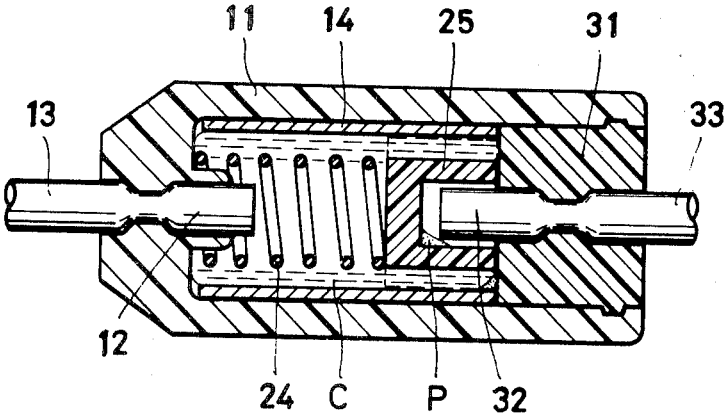

The sliding means 25 illustrated as an example in FIG. 3(A) has a shape such that it fits snugly to the interior of the housing 11 and is provided on the periphery thereof with grooves or conduits serving the purpose of ensuring the continuity of the spaces formed on both sides of the sliding means within the housing. The cavity of the sliding means 25 serves its purpose sufficiently when its diameter is large enough to admit amply the terminal 32 to be inserted therein and its depth is greater than the length of the portion of the terminal 32 which extends from the forward surface of the bushing 31. As illustrated in FIG. 3(B), the thermal pellet P which retains its solid state at normal temperatures is held in position inside this cavity. Be virtue of the solid state of this thermal pellet P, the sliding means 25 remains stably in position in spite of the urging force of the spring 24 and permits connection between the spaces formed around the peripheries of the two terminals 12, 32. Consequently, the space S between the two terminals is filled with the conductive material C which fulfils its purpose of establishing continuity between the two terminals.

When temperature around this thermal fuse rises and reaches the preset temperature level, the thermal pellet P is melted and is decreased in volume. As a result, the sliding means 25 is moved by the urging force of the spring 24 until it comes into contact with the bushing 31, isolating the space formed around the periphery of the terminal 32. The movement of the sliding means 25 severs the conductive material C which has connected the two terminals to each other. Thus, the electric continuity between the two terminals is broken to attain the object of the fuse.

In the present preferred embodiment, a metal tube 14 laid intimately on the inner surface of the housing 11 is intended to lower the resistance between the two terminals as when the conductive material C used happens to possess a low degree of conductivity. This metal tube, therefore, need not be incorporated when the conductive material to be used possesses a high degree of conductivity.

Figure 4:
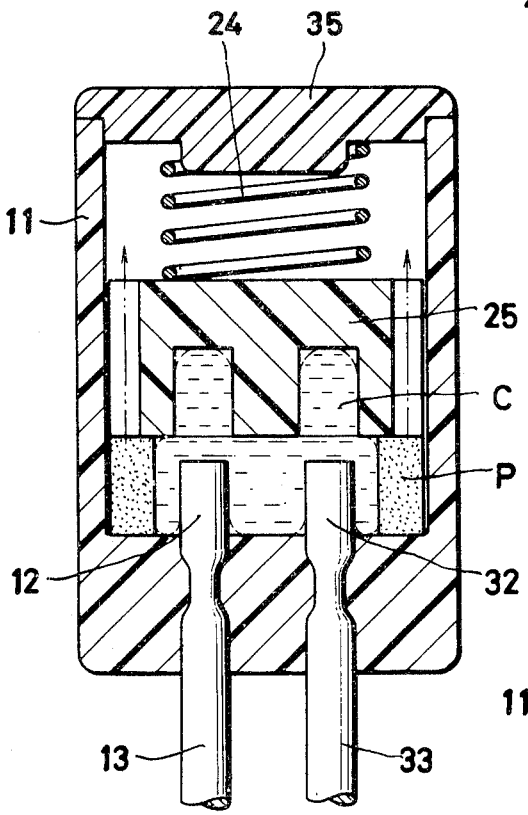
FIG. 4 is a sectional side view of the third preferred embodiment of the thermal cut-off fuse of the preferred embodiment in the state of closed continuity.

The third preferred embodiment illustrated in FIG. 4 represents a case wherein two lead wires 13, 33 issue out of one same side of the thermal cut-off fuse proper. The pair of corresponding terminals 12, 32 are disposed parallelly to each other inside the housing. The sliding means 25 which is destined to cover these two terminals is provided with two cavities for admitting insertion of the two terminals. The spring 24 which is pressed down by a lid 35 placed to close the opening formed in the housing 11 on the side opposite the side containing the two terminals constantly urges the sliding means 25 in the direction of the bottom face of the housing 11 containing the terminals 12, 32. Since a cylindrical thermal pellet P which retains its solid state at normal temperatures is interposed between the bottom face of the housing 11 and the sliding means 25, a continuous space is formed to surround the peripheries of the two terminals. The conductive material placed to fill this continuous space, therefore, serves the purpose of establishing electric continuity between the two terminals.

When the temperature around this thermal cut-off fuse rises to reach the preset temperature level, the thermal pellet P melts and the conductive material C which has already been fluidified by the elevated temperature flows into the chamber containing the spring through the grooves formed on the periphery of the sliding means 25. Consequently, the sliding means 25 is moved by the urging force of the spring 24 until it collides into the bottom face of the housing 11, insulating the spaces formed around the peripheries of the two terminals from each other. Thus, the electric continuity between the two terminals is broken.

Figure 5A:
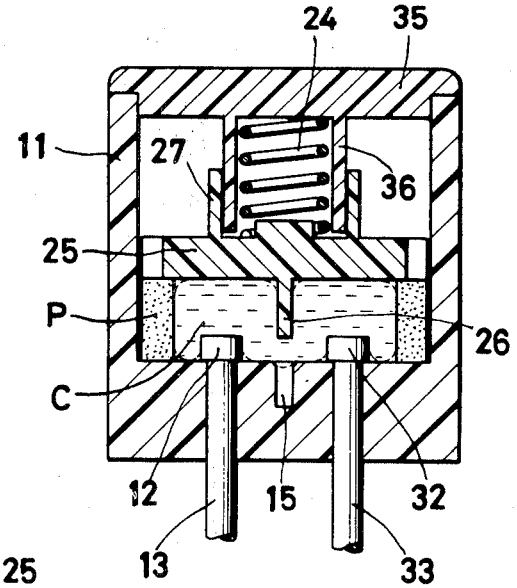
FIGS. 5(A) and 5(B) are sectional side views of the fourth preferred embodiment of the thermal cut-off fuse of the present invention, respectively in the state of closed continuity and in the state of broken continuity.
Figure 5B:
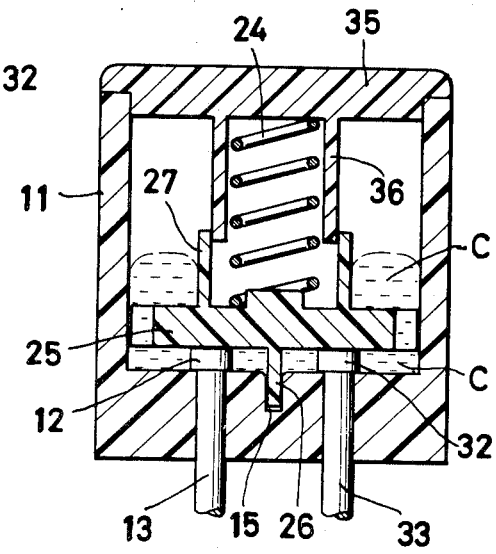

Instead of resorting to the use of two cavities bored in the sliding means 25 for admitting the two terminals as involved in the preferred embodiment described above, the state of broken continuity between the two terminals can be obtained by adopting a means capable of separating the spaces surrounding the two terminals from each other as illustrated in FIG. 5. This means comprises a partition wall 26 disposed on the side of the sliding means 25 facing toward the bottom face of the housing 11 and a partition groove 15 formed in the bottom face of the housing for admitting the partition wall 26. At normal temperatures, the conductive material C fills the space defined by the bottom face of the housing 11, the sliding means 25 and the solid thermal pellet P. When the temperature around the fuse rises to reach the preset temperature level, the thermal pellet melts and the conductive material C consequently flows into the chamber containing the spring 24 via the grooves formed around the periphery of the sliding means 25 as illustrated in FIG. 5(B). As a result, the sliding means 25 is moved to the bottom face of the housing, causing the partition wall 26 to insert into the partition groove 15 and separate the spaces surrounding the two terminals from each other. If, in this case, the upper chamber containing the spring 24 constitutes one integral space, then the conductive material C which has flowed into this chamber combines into one continuous mass and eventually establishes electric continuity between the two terminals. For the purpose of preventing such formation of one continuous mass of the conductive material within the upper chamber containing the spring, at least one inner barrier 36 is extended downwardly from the lid 35 and an outer barrier 27 is extended upwardly from the upper surface of the sliding means 25. These barriers fit snugly to each other and prevent the portions of the fluidified conductive material C flowing into the chamber through the opposite lateral sides from combining into one continuous mass, enabling the state of broken continuity to be retained.

Figure 6:
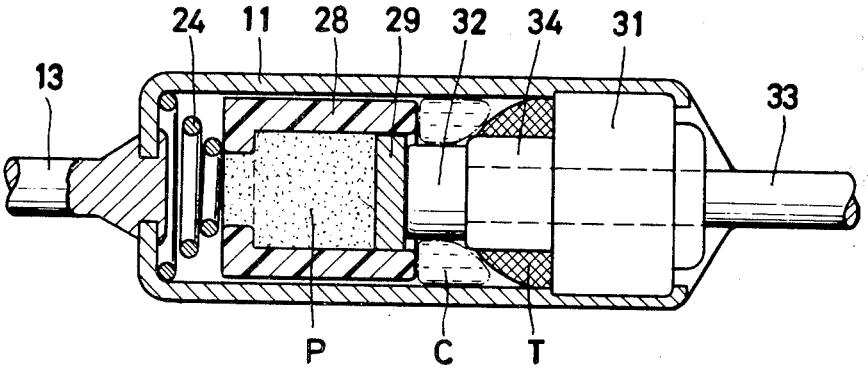
FIGS. 6(A) and 6(B) are a sectional side view of the fifth preferred embodiment of the thermal cut-off fuse of the present invention in the state of closed continuity and a partially enlarged sectional view of the thermal cut-off fuse in the state of broken continuity.
Figure 6:
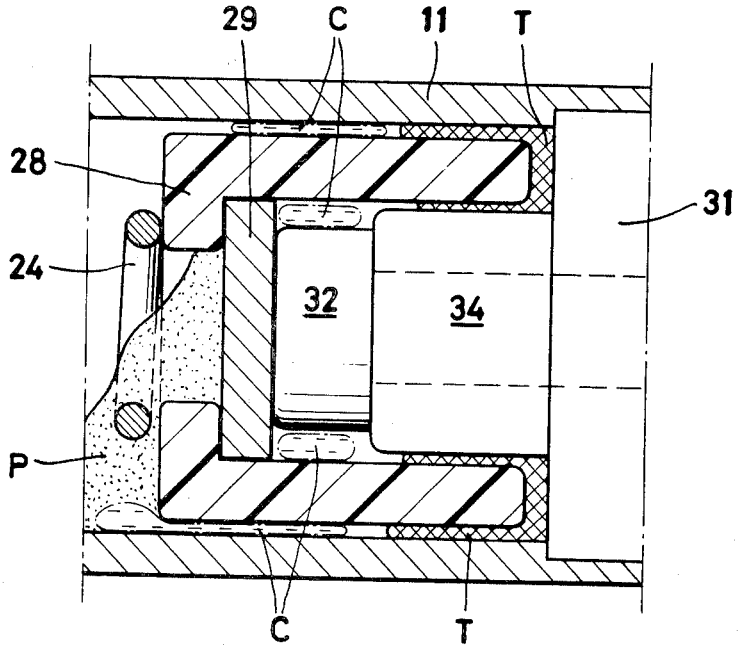
Figure 7A:
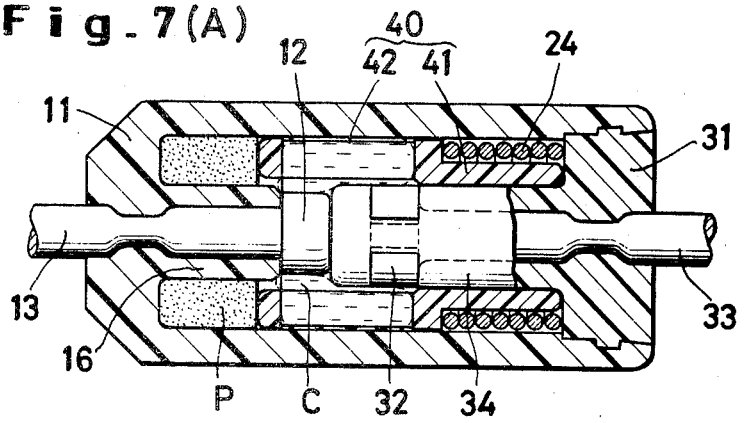
FIGS. 7(A) and 7(B) are sectional side views of the sixth preferred embodiment of the thermal cut-off fuse of the present invention, respectively in the state of closed continuity and in the state of broken continuity.
Figure 7B:
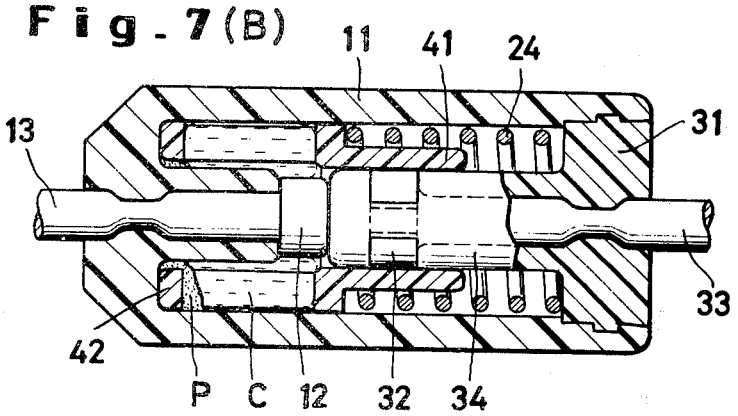
Figure 7C:
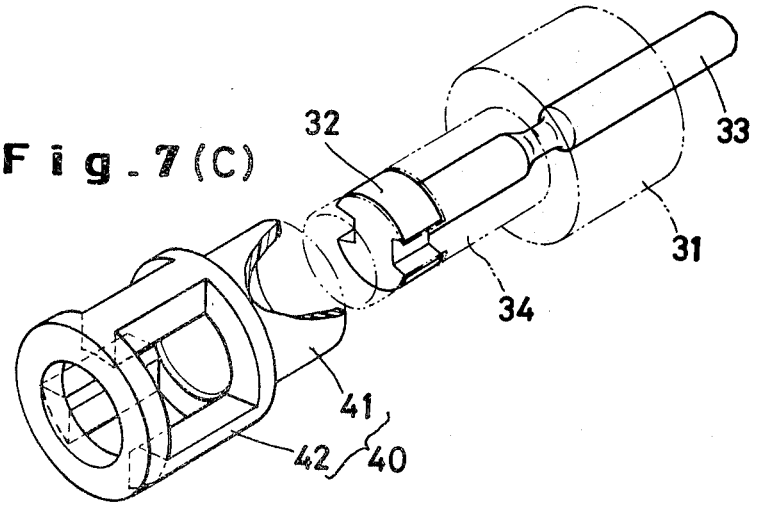
FIG. 7(C) is a partially cutaway, exploded, perspective view of a sliding member, terminals and a bushing to be used in the sixth preferred embodiment of the thermal cut-off fuse of the present invention.

The fifth preferred embodiment illustrated in FIG. 6 represents a case wherein the housing 11 is electrically conductive so that the housing in its entirety serves as an electrode when one lead wire 13 is electrically connected to a part of this housing. The other lead wire 33 is extended through the bushing 31 and the sleeve 34 to form a terminal 32 at its inner end inside the housing 11. The sliding means 28 is cylindrical in shape and is filled with the thermal pellet P. Inside the housing 11, the sliding means is urged by the spring 24 from the lead wire 13 side and is held in contact, through the medium of a packing 29, with the terminal 32 positioned at the leading end of the bushing 31 inserted from the other end. Since the thermal pellet P which is retained in a solid state at normal temperatures offers resistance to the urging force of the spring exerted upon the sliding means 28, there is formed a space between the conductive housing 11 and the terminal 32. The conductive material C which is placed to fill this space serves to establish electric continuity between the two lead wires. In this construction, when the surrounding temperature rises and reaches the preset temperature level, the thermal pellet P is melted and consequently moved by the urging force of the spring in the direction of the terminal 32. Consequently, the thermal pellet P which is melted inside the sliding means 28 is pushed out by the packing 29 and causes to flow into the chamber of the spring 24 through the opening bored on the lead wire 13 side. If the leading end of the sliding means 28 on the bushing 31 side should be allowed to have a slight gap between itself and the bushing 31, the conductive material C might possibly establish electric continuity between the terminal 32 and the housing 11 via this slight gap. For the purpose of precluding this possibility, therefore, grease or some other suitable adhesive agent T is applied to the base of the sleeve before the bushing 31 is inserted into the housing 11. The grease, when the thermal pellet is melted and the sliding means 28 is consequently moved in the direction of the bushing 31, serves the purpose of filling up any gap possibly formed between the sliding means and the bushing and cutting off the possible path for the conductive material Another preferred embodiment of the thermal cut-off fuse having a construction such that perfect breakage of the state of continuity is ensured is illustrated in FIG. 7. In this sixth preferred embodiment, the lead wire 13 is fixed to the housing 11 and extended, in a state insulated by the sleeve 16, into the housing interior and only the terminal 12 at the leading end of the lead wire 13 is exposed inside the housing. At the other end, the lead wire 33 and the terminal 32 which are integrally formed in a shape as shown in FIG. 7(C) are enclosed with the bushing 31 of a plastic material, with only a part of the lateral face of the terminal 32 exposed out of the bushing 31. The sliding means 40 of the construction of FIG. 7(C) establishes the state of closed continuity and that of broken continuity by respectively opening and closing the exposed portion of the lateral face. This sliding means 40 comprises a cylinder 41 having an inside diameter conforming exactly with the outside diameter of the terminal formed integrally with the sleeve 34 and a cylindrical frame 42 formed concentrically with the cylinder 41. The thermal pellet P is placed between the housing and the sleeve 16 before these component parts are assembled within the housing. Then, a proper amount of the conductive material C, the sliding means 40 and the spring 24 are inserted in position and the bushing 31 is set in position to close the opening of the housing 11. Inside the housing in which all the component parts have been set in position, the thermal pellet P which retains a solid state at normal temperatures stops the sliding means 40 at a position quite close to the housing 11 in spite of the urging force exerted by the spring 24 in the direction of the terminal 12. In this case, since the cylindrical frame 42 portion of the sliding means 40 is positioned so as to override the two terminals at the same time, the space surrounding the terminal 12 and that surrounding the other terminal 32 continue into each other. The conductive material C which is placed to fill this continuous space establishes electric continuity between the two terminals.

When the ambience of the fuse rises and reaches the preset temperature level, the thermal pellet P is melted and the sliding means 40 is moved by the energizing force of the spring 24 in the direction of the terminal 12. Consequently, the exposed lateral face of the terminal 32 is closed with the cylinder 41 of the sliding means 40 and the continuity between the two terminals is completely broken.

According to the present invention, because of the use of a thermal pellet which excels in the precision of response to temperature, the thermal cut-off fuse of this invention operates with high sensitivity at the preset temperature level to provide perfect insulation of at least one of the pair of terminals and effects perfect breakage in the electric continuity between the two terminals. Thus, the fuse of this invention enjoys high reliability of operation. As compared with many conventional switches inserted in electric circuits which have narrow areas of contact and, therefore, suffer from undesirably high contact resistance and degraded efficiency, the thermal cut-off fuse of the present invention establishes electric continuity in an ideal condition between the pair of terminals and, accordingly, exhibits a low degree of specific resistance and high efficiency.

What is claimed is:

1. A thermal cut-off fuse comprising a housing, first and second lead wires extending from said housing with at least said first lead wire extending into the interior of said housing, a conductive fluid initially in contact in said interior with at least said first lead wire for completing an electrical circuit to said second lead wire, slideable means comprising an electrically insulating barrier means initially disposed at a point remote from said first lead wire, spring means which initially tends to force said slideable means toward said first lead wire and an initially solid pellet positioned so as to restrain said spring means from forcing said slideable means toward said lead wire until a predetermined temperature is reached and said pellet melts, said slideable means being constructed so that upon the melting of said pellet said barrier means is interposed relative to said first lead wire so that any conductive fluid that remains in contact with said first lead wire is completely electrically isolated from the rest of the conductive fluid in said interior of said housing by said barrier means, which breaks the electrical circuit that otherwise would be made between said first and second lead wires through said conductive fluid in the absence of said barrier means.

2. A thermal cut-off device as claimed in claim 1 wherein said barrier means has a cavity that conforms substantially to the shape of the portion of said first lead wire in said interior.

3. A thermal cut-off device as claimed in claim 2 further comprising a soft coating material around said portion of said first lead wire wherein said barrier means is driven into said coating material when said pellet melts.

4. A thermal cut-off device as claimed in claim 1 wherein said conductive fluid initially contacts both of said lead wires.

5. A thermal cut-off device as claimed in claim 1 wherein said housing is electrically insulating and a conductive sleeve is inserted inside of said housing in contact with said conductive fluid.

6. A thermal cut-off device as claimed in claim 1 wherein said lead wires are radial lead wires and both of said lead wires have portions that extend into said housing and said barrier means is interposed in said conductive fluid between said portions of said lead wires.

7. A thermal cut-off device as claimed in claim 6 wherein said barrier means has two cavities and each of these conforms substantially to the shape of the portion of one of said lead wires in said interior.

* * * * *